United States Patent [19]

Watkins

[11] Patent Number: 4,658,739

[45] Date of Patent: Apr. 21, 1987

[54] NEEDLE PLATE MEMBER FOR A STAGGERED NEEDLE TUFTING MACHINE

[75] Inventor: Charles W. Watkins, Ooltewah, Tenn.

[73] Assignee: Tuftco Corporation, Chattanooga, Tenn.

[21] Appl. No.: 825,564

[22] Filed: Feb. 3, 1986

[51] Int. Cl.[4] ..... D05C 15/08; D05C 15/14

[52] U.S. Cl. ..... 112/80.3; 112/80.31

[58] Field of Search ..... 112/79 R, 266.2

[56] References Cited

U.S. PATENT DOCUMENTS

| | | | |
|---|---|---|---|
| 3,393,654 | 7/1968 | Barnes | 112/79 R |
| 3,398,708 | 8/1968 | Card | 112/79 R |
| 3,492,956 | 2/1970 | Webb | 112/79 R |
| 3,641,956 | 2/1972 | Ownbey | 112/79 R |
| 4,224,884 | 9/1980 | Shortte | 112/79 R |
| 4,503,787 | 3/1985 | Watkins | 112/79 R |
| 4,548,140 | 10/1985 | Price et al. | 112/79 R |
| 4,557,209 | 12/1985 | Watkins | 112/266.2 |

*Primary Examiner*—Ronald Feldbaum

*Attorney, Agent, or Firm*—Harrington A. Lackey

[57] ABSTRACT

A needle plate member for a staggered needle tufting machine in which the rear free edge of the needle plate is provided with transversely spaced notches therein for receiving the passage of the front needles while supporting the base fabric being stitched by the front needles and a plurality of rearward projecting forked finger members alternating with the notches and projecting rearward of the rear free edge of the needle plate for receiving the passage of the vertically reciprocable rear needles while supporting the portions of the base fabric stitched by the rear needles. The needle plate member is particularly adapted for use with a separate mechanism for laterally shifting the base fabric in a staggered needle tufting machine to produce dense tufted pile fabric and particularly pile fabric having multiple rows of stitching transversely spaced less than the needle gauge.

9 Claims, 20 Drawing Figures

10
10

NEEDLE PLATE MEMBER FOR A STAGGERED NEEDLE TUFTING MACHINE

BACKGROUND OF THE INVENTION

This invention relates to a staggered needle tufting machine and more particularly to a needle plate member for supporting the base fabric in a staggered needle tufting machine.

In a conventional multiple needle tufting machine, the needle plate is provided with a plurality of uniformly spaced straight fingers extending from one edge of the plate in the direction of the fabric feed, or rearward, so that each finger extends between and beyond an adjacent pair of needles. These fingers are adapted to provide a support for the portion of the base fabric in the path of the needles and are spaced to permit free reciprocation of the needles between the fingers. In a conventional multiple needle tufting machine, the needle plate fingers are uniformly spaced at the same gauge as the needles.

Furthermore, a conventional needle plate finger has a rectangular cross-section, with its short dimension transverse, and its long dimension vertical. Thus, each cantilevered needle plate finger has substantial depth to provide sufficient strength to support the base fabric as the fabric is penetrated by the needles. Moreover, the short transverse dimension of each needle plate finger is desirable so that the needles can be spaced closer together to achieve finer gauges.

Generally speaking, in order to form tufted loops of low pile having as short a nap as possible, the hooks are mounted to move as closely as possible beneath the bottom surfaces of the needle plate fingers, and the height of the bills of the loopers is reduced to a minimum. To reduce the depth of conventional needle plate fingers would materially reduce their strength and rigidity to a degree that the needle plate fingers would not adequately support the base fabric as the fabric is penetrated by the needles carrying the yarns.

Examples of various types of prior art needle plates are shown in the following U.S. Pat. Nos.

| | | |
|---|---|---|
| 2,975,736 | J. L. Card | Mar. 21, 1961 |
| 2,976,829 | R. T. Card | Mar. 28, 1961 |
| 3,019,748 | J. L. Card | Feb. 6, 1962 |
| 3,064,600 | R. T. Card | Nov. 20, 1962 |
| 3,241,507 | G. D. Dedmon, et al | Mar. 22, 1966 (Base plate 62-FIG. 4) |
| 3,361,095 | J. T. Short | Jan. 2, 1968 |
| 3,398,708 | R. T. Card | Aug. 27, 1968 |

Both J. L. Card patents disclose typical conventional needle plates having longitudinal grooves receiving elongated needle plate fingers of rectangular cross-section having a greater depthwise dimension than its transverse dimension.

The three R. T. Card patents disclose needle plates having needle plate fingers of varying configurations to accommodate narrow gauge, staggered needles.

The Dedmon et al patent discloses a "usual base plate 62" in which the needle plate fingers appear to have been formed by milling the trailing edge of the base plate to produce long needle plate fingers of substantial depth.

The Short patent discloses a needle plate of substantial thickness having a plurality of uniquely shaped recesses in the trailing edge of the needle plate especially formed to accommodate hollow, cylindrical needles of the type through which a fluid is discharged to carry the yarn through the hollow needle and fabric.

None of the above patents disclose a needle plate which is capable of producing very low pile loops in a tufted fabric.

There has been a trend in the tufting industry toward the production of tufted fabrics having a very low, as well as dense, pile, simulating products resembling velvet. The height of the tufted loops have been reduced by reducing the height of the bills of the looper hooks, but further reduction of the pile height has been limited by the finite depth of the needle plate fingers.

Substantially low pile tufted fabrics have been produced by utilizing a needle plate such as that disclosed in U.S. Pat. No. 4,503,787 of Charles W. Watkins, dated Mar. 12, 1985, for "LOW PILE NEEDLE PLATE FOR TUFTING MACHINE" and which has been assigned to the assignee of this application. The above Watkins low pile needle plate has been utilized very successfully in the production of low cut pile tufted fabrics by in-line multiple needle tufting machines. In order to successfully produce low pile tufted fabric with the Watkins needle plate in a staggered needle tufting machine, the tops of the tufting hooks must be high enough to support the backing fabric. As the tufting hooks are lowered, the portions of the backing fabric penetrated by the rear needles over the tufting hooks is not adequately supported, even though the portions of the backing fabric stitched by the front needles are adequately supported by the notched needle plate.

It has been discovered that by laterally and reciprocably shifting the moving backing fabric relative to the stationary needle plate of the Watkins U.S. Pat. No. 4,503,787 in an in-line tufting machine, dense pile tufted fabric of superior quality is produced. However, when the mechanism for laterally shifting the backing fabric is incorporated with the Watkins low pile needle plate in a staggered needle tufting machine, the portions of the backing fabric stitched by the rear needles are not adequately supported.

Dense tufted pile fabric in which there is relative lateral movement between the backing fabric and the needles has been produced in accordance with one or more of the following U.S. Pat. Nos.

| | | |
|---|---|---|
| 3,301,205 | R. T. Card | Jan. 31, 1967 |
| 3,577,943 | Watkins | May 11, 1971 |
| 4,440,102 | R. T. Card, et al | Apr. 3, 1984 |

In the above R. T. Card U.S. Pat. No. 3,301,205, the relative movement between the fabric and the needles is attained by laterally shifting the needle plate in order to form loop pile.

In the Watkins U.S. Pat. No. 3,577,943, the relative movement is attained by laterally shifting the needle plate for producing cut pile tufted fabric. The needles are programmed to penetrate the backing fabric while the fabric is laterally shifting.

In the R. T. Card, et al, U.S. Pat. No. 4,440,102, the relative lateral movement is attained by laterally shifting the needle bar relative to the fabric. The needles penetrate the fabric as the needles are laterally shifting.

Although Watkins (U.S. Pat. No. 3,577,943) discloses relatively short needle plate fingers 30 projecting rearwardly from the free rear edge of the needle plate 28, nevertheless, this needle plate is used in combination with an in-line multiple needle tufting machine. Although Watkins, in Col. 4, lines 28–32, states that it is contemplated that his machine can be used with staggered needles, nevertheless, there is no teaching in the Watkins patent of any structure which would adequately support the portions of the base fabric penetrated by the rear needles, as well as the front needles.

A conventional "jute shifter" has been utilized in jogging or laterally shifting the base fabric in small increments in combination with conventional needle plates having conventional long and thick needle fingers, with limited success. Both the large size of the needle fingers and the fact that the loops are held on the looper hooks while the fabric is laterally shifted, substantially restrain the lateral movement of the base fabric and therefore the formation of the zig-zag stitching to produce dense tufted pile fabric. Moreover, this problem is compounded where the needle fingers are conventionally longer to project between staggered rows of needles, and particularly in fine gauge staggered needle tufting where the yarns become quite crowded and bind upon the needle plate fingers.

SUMMARY OF THE INVENTION

It is therefore an object of this invention to provide a uniquely constructed needle plate member which will adequately support all portions of the backing fabric penetrated by both the front and rear needles in a staggered needle tufting machine.

It is also an object of this invention to provide a needle plate member which will adequately support the backing or base fabric moving through a staggered needle tufting machine, whether the backing fabric is moved longitudinally straight through the machine, or whether the backing fabric is laterally shifted relative to the needle plate member and the needles.

The needle plate member made in accordance with this invention has transversely spaced rearward opening notches formed in its free rear edge portion, similiar to the notches disclosed in the low pile needle plate of the Watkins U.S. Pat. No. 4,503,787, for supporting the portions of the base fabric penetrated by the front needles of a staggered needle tufting machine. Moreover, the needle plate member made in accordance with this invention is further provided with forked needle plate fingers projecting rearward from the free rear edge of the needle plate and alternating with the notches, in order to adequately support the portions of the backing fabric penetrated by the rear needles of the staggered needle tufting machine. Because of the relative strength of the needle plate which is preferably of solid material, and including the notches in the rear edge thereof, the needle plate fingers projecting from the rear edge do not have to be as long or have the width or depth of conventional needle plate fingers. Thus, with the reduced dimensions in both the depth or thickness of the needle plate per se, and the needle plate fingers, the looper hooks may be vertically spaced closer to the needle plate member than to conventional needle plates, albeit not as close as the spacing between the looper hooks in the low pile needle plate of the Watkins U.S. Pat. No. 4,503,787.

The construction of the needle plate member permits the free exit of the loops formed on the looper hooks from the notches and the spaces between the needle plate fingers as the base fabric moves rearwardly. Furthermore, when a fabric shifting mechanism is used for laterally shifting the base fabric in a wave-like or zig-zag pattern to form dense pile fabric, the lesser dimensions of the needle plate fingers, the large rear openings in the notches, and spaces between the forked ends of the fingers facilitate the release and movement of the yarn loops, to form dense pile fabric, and particularly dense cut pile tufted fabric of uniform texture and high quality, even in a fine gauge staggered needle tufting machine.

The utlization of the relatively open notches and the needle plate fingers of smaller dimensions permits greater freedom of movement of the formed loops and a minimum of interference to the rapid transverse movement of the backing fabric when shifted, yet still provides more than adequate support for all portions of the backing fabric penetrated by both rows of needles in a staggered needle tufting machine.

DESCRIPTION OF THE PREFERRED EMBODIMENTS

Figures 1, 2, 13, 14, 15, 16, 17, 18:
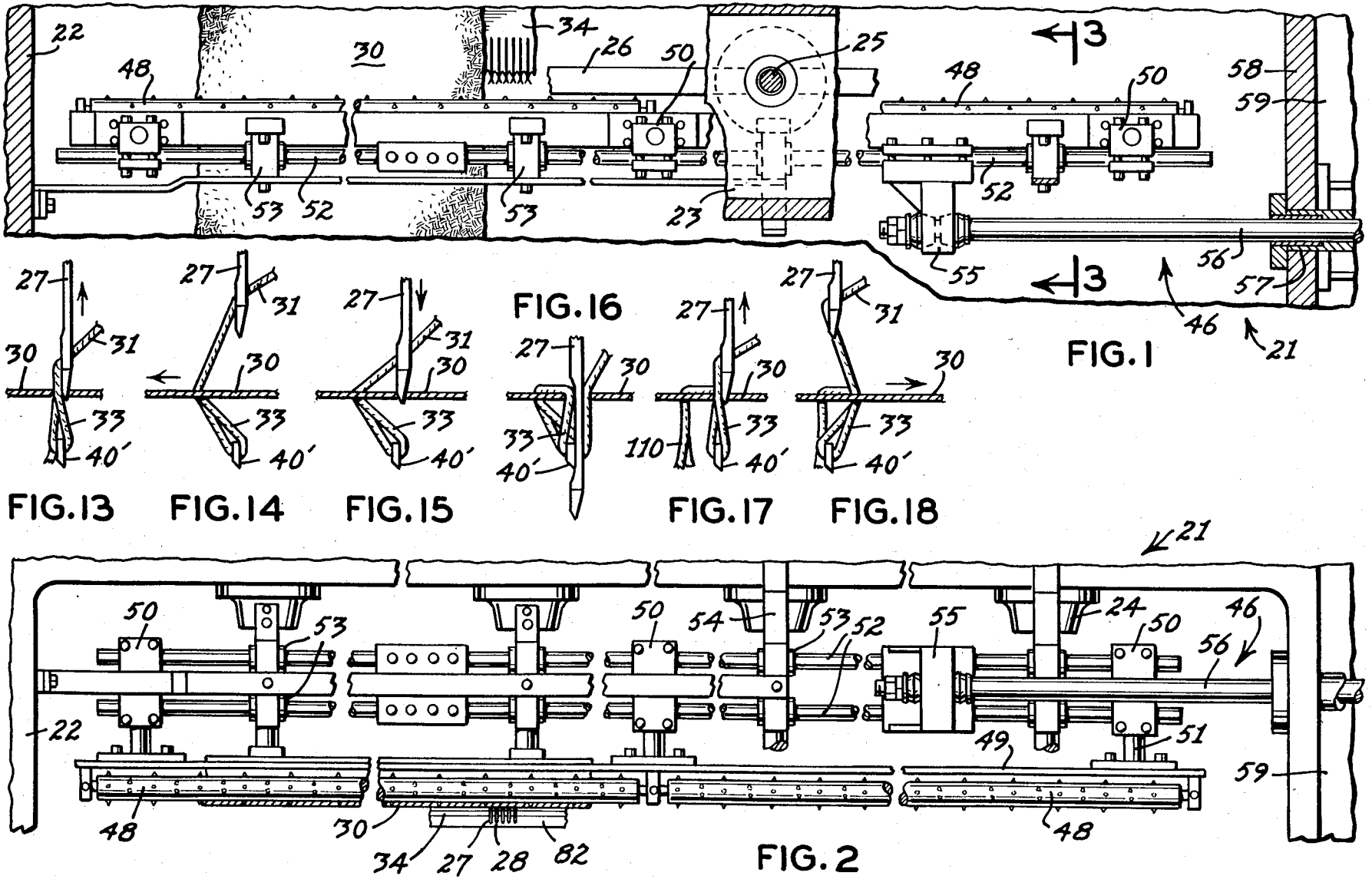
FIG. 1 is a fragmentary top plan view of a staggered needle tufting machine incorporating a needle plate member made in accordance with this invention and a backing fabric shifter mechanism.
FIG. 2 is a fragmentary rear elevation of the machine disclosed in FIG. 1.
FIGS. 13–18 are schematic sectional elevations illustrating one form of stitching sequence.

The staggered needle tufting machine 21 includes a frame 22 and a needle drive housing 23. Reciprocably mounted within each or a plurality of bearings 24 in the needle drive housing 23 is a push rod 25 fixed to a transverse needle bar 26. The needle bar 26 supports a first row of uniformly spaced front needles 27 and a second row of uniformly spaced rear needles 28 uniformly staggered between the front needles 27. The push-rods 25 are reciprocated vertically by a conventional needle drive mechanism, not shown, to cause the front and rear needles 27 and 28 to move between an upper position, not shown, above the base fabric 30 to a lower position (FIG. 3) penetrating the base or backing fabric 30, so that the needles will carry the yarns 31 and 32 through the base fabric 30 to form loops 33 of tufting therein.

Figure 3:
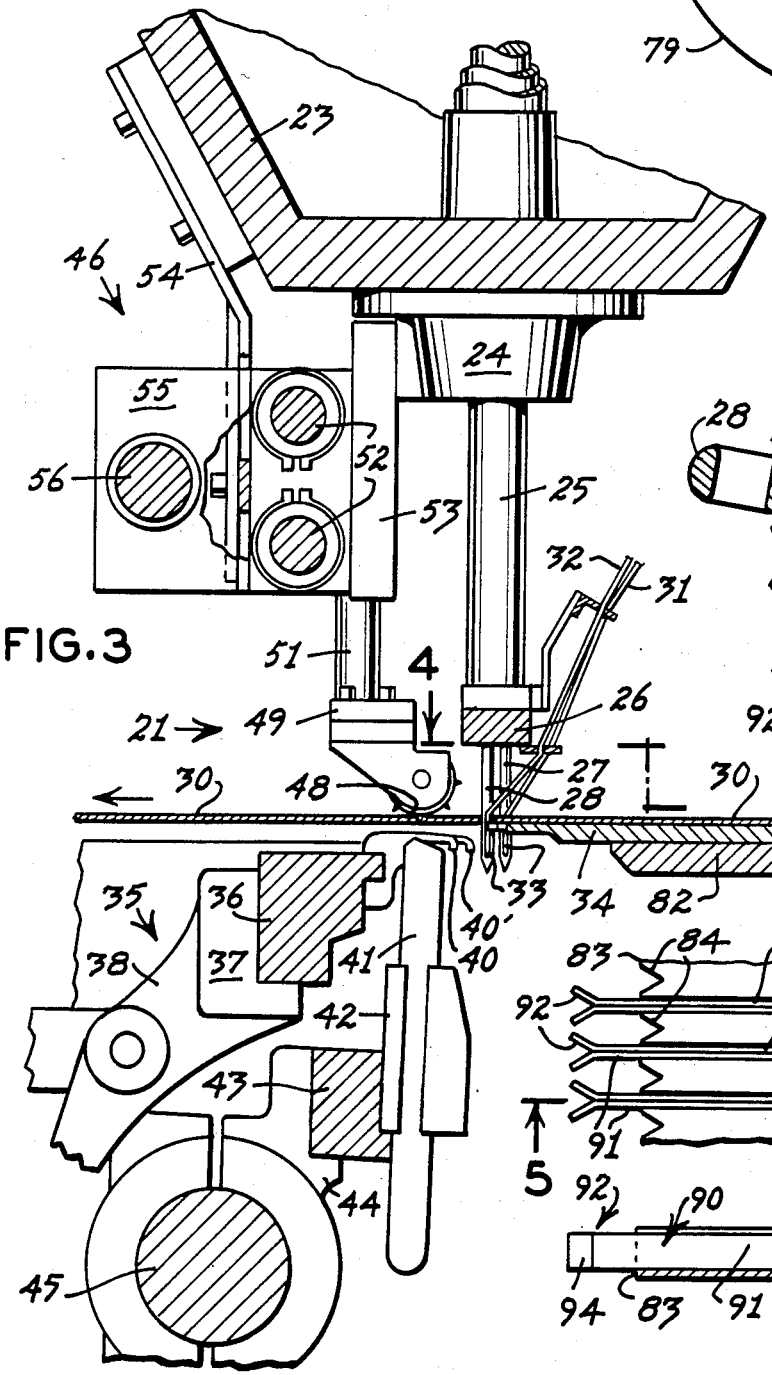
FIG. 3 is a greatly enlarged fragmentary section taken along the line 3—3 of FIG. 1.

The base fabric 30 is supported upon the needle plate member 34, made in accordance with this invention, for movement by means not shown, in the direction of the arrow in FIG. 3, that is longitudinally from front-to-rear through the machine 21.

As best disclosed in FIG. 3, the looper apparatus 35 which cooperates with the needles 27 and 28 includes a transverse hook bar 36 supported upon a plurality of transversely spaced brackets 37 fixed to corresponding rocker arms 38 journaled on a rock shaft, not shown. The rock shaft is driven by conventional means, not shown, to cause limited reciprocable movement of the hook bar 36 in synchronism with the reciprocable movement of the needle bar 26.

Supported within the hook bar 36 are a plurality of transversely spaced loop pile hooks 40 and 40[1] of conventional construction, and staggered to cooperate with the staggered needles 27 and 28. As disclosed in FIG. 3, the cut pile hooks 40 and 40[1] point forward in the direction opposing the fabric feed.

A knife 41 is provided for each looper hook 40 and 40[1] to cooperate with the corresponding hooks to produce cut pile tufts. The knives 41 are mounted in knife blocks 42 carried upon a transverse knife bar 43, which in turn is carried by the arms 44 mounted on the reciprocably driven rotary knife shaft 45. The knife shaft 45 and the means for driving the hook bar 35 and the needle bar 26 are all driven sychronously by means well-known in the art to cause the needles 27 and 28, the cut pile hooks 40 and 40[1], and the knives 41 to cooperate to form cut pile tufts from the yarns 31 and 32.

In a preferred form of the invention, a fabric shifter mechanism 46, such as a conventional jute shifter, is mounted on the rear portion of the tufting machine 21 in order to engage and laterally shift the base or backing fabric 30. The fabric shifter mechanism 46 includes a freely rotatable, transversely extending, pin roller 48 rotatbly supported within the bracket 49 and connected to slide blocks 50 by depending rods 51. Each of the slide blocks 50 is fixed to the slide shafts 52 which are supported for shiftable sliding movement in the bushings 53 fixed by brackets 54 to the rear of the needle drive housing. Fixed to the slide rods 52 by a connector bracket 55 is a transverse push-rod or shift rod 56.

The transverse shift rod 56 is slidably received within a bearing 57 within a wall 58 into a drive compartment 59. The shift rod 56 is pivotally connected through a link bar 60 to a cross head 61 pivotally supported by a pin 62 to a base plate 63. The opposite end of the cross head 61 is pivotally connected through link bar 64 to a cam follower carrier 65. The carrier 65 is provided with the plurality of slide rods 66 adapted to slide in bearings 67 fixed to the mounting plate 63 and to an upper plate 68 supported on the mounting plate 63.

Figure 12:
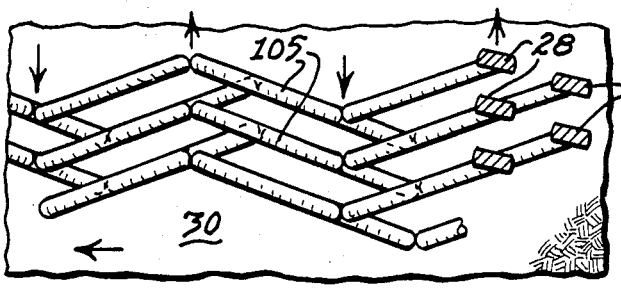
FIG. 12 is a fragmentary top plan view of the backing fabric schematically disclosing the rows of stitching.

The carrier 65 also supports a pair of freely rotatable cam follower rollers 70 in horizontal alignment and adapted to rollably engage the diametrically opposite edges of a rotary cam 72. The peripheral edge of the cam 72 is of the desired pattern configuration for controlling or programming the laterally shiftable movement of the pin roller 48. The center of the cam 72 is fixed to a driven shaft 73 of a gear reducer 74 mounted on the mounting plate 63. The gear reducer 74 has an input shaft 75 connected by a sprocket and chain transmission 76 to the main drive shaft 77 of the tufting machine 21. Thus, as the main drive shaft 77 is driven by the main drive motor, not shown, the shift rod 56 is longitudinally reciprocated in response to the rotary movement of the pattern cam 72 to shift the pin roller 48 and the backing fabric 30 supported by the pin roller 48 laterally back and forth over the needle plate 34. As the needles 27 and 28 stitch the yarns 31 and 32 through the shifting backing fabric 30, a wave-like or zig-zag stitching pattern such as disclosed in FIG. 12, is produced in the backing fabric 30.

Figure 11:
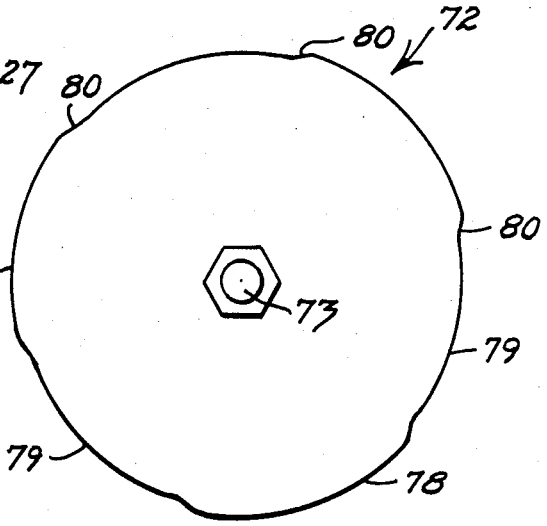
FIG. 11 is a rear elevational view of one form of pattern cam utilized in the pattern control mechanism.

As disclosed in FIG. 11, the pattern cam 72 is provided with three lobes or lands 78 of uniform circumferential length and uniformly spaced by the arcuate recesses 79. The recesses 79 merge with the lands 78 gradually through the sloping shoulder portions 80. The radial differences between the lands 78 and the arcuate recesses 79 determine the lateral shifting distance of the pin roller 48 relative to the needle plate member 34.

The needle plate member 34 is preferably constructed of a plurality of needle plates or needle plate sections, arranged end-to-end transversely of the tufting machine 21. The needle plate member 34 is preferably made of a rectangular sheet of unitary solid material, such as spring steel, of relatively thin gauge or thickness. The needle plate member 34 is supported upon an elongated mounting plate 82 adapted to be supported upon the bed plate, not shown, of the tufting machine 21.

Formed in the rear or trailing edge 83 of the needle plate member 34 are a plurality of open notches 84 preferably of uniform size and transverse spacing. Each notch 84 is only large enough to accommodate, that is to receive, a front needle 27 as it penetrates the base fabric 30. The edges 85 and 86 of each notch 84 are spaced as closely as possible to a corresponding needle 27 to support a maximum area of the base fabric 30 adjacent the corresponding front needle 27, without interfering with the movement of the respective needle 27.

Figure 6:
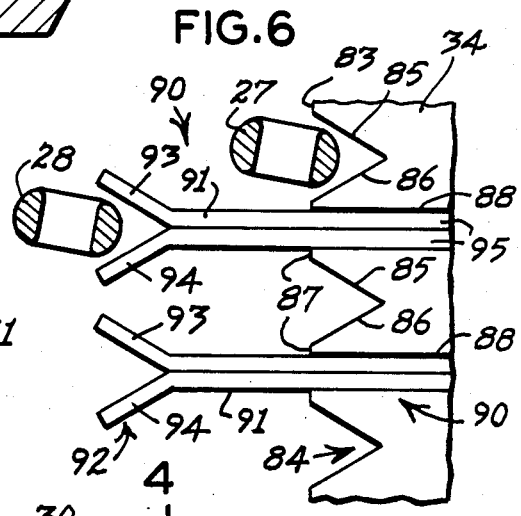
FIG. 6 is a greatly enlarged fragmentary plan view of a rear edge portion of the needle plate member.

As disclosed in FIG. 6, the notches 84 are V-shaped, each having a pair of opposed angular edges 85 and 86 disposed closely adjacent the opposite sides of the path of a corresponding front needle 27. The walls 85 and 86 diverge symmetrically about the longitudianal median of the angular notch 84, which median coincides with the center of each corresponding front needle 27. The diverging side walls 85 and 86 open through the trailing edge 83 of the needle plate member 34 to provide ample room for the exit of each tufted loop 33 formed by the corresponding needle 27.

The notches 84 are spaced apart to define lands 87 along the trailing edge 83 of the needle plate member 34. The lands 87 are also preferably equally spaced from each other and the adjacent notches 84. The median of each land 87 is preferably longitudinally centered with each corresponding rear needle 28.

Formed in the top surface of the needle plate member 34 and extending through the rear edge 83, and specifically through each land 87, is an elongated finger groove 88 to snugly receive an elongated rearward projecting needle plate finger or finger member 90 made in accordance with this invention. Each needle plate finger member 90 includes a substantially straight shank portion 91 terminating in a rear forked end portion 92. In a preferred construction, each needle plate finger member 90 is substantially Y-shaped so that its forked end portion 92 is substantially V-shaped and comprises a pair of rearward diverging tines 93 and 94.

Figure 4:
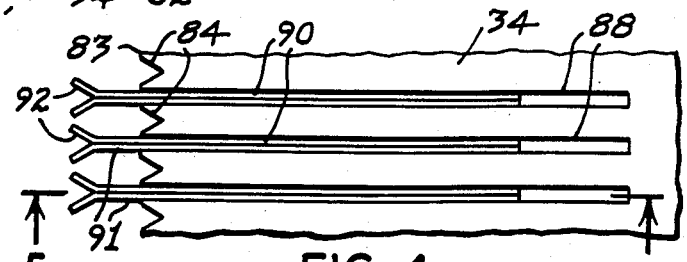
FIG. 4 is an enlarged fragmentary section taken along the line 4—4 of FIG. 3.
Figure 5:
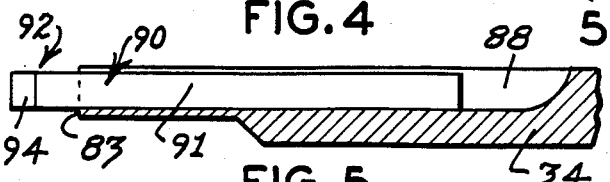
FIG. 5 is a fragmentary section taken along the line 5—5 of FIG. 4.

As disclosed in the drawings, and particularly in FIGS. 4–6, the finger members 90 may be constructed of a pair of long, flat wires 95 of the same shape, each having an angular end portion arranged to form the diverging tines 93 and 94. The abutting straight portions of the wires 95 form the shank portion 91.

Although the depth or height of each finger member 90 is greater than its transverse dimension or width, nevertheless, the length and depth of each finger member 90 is less than that or a corresponding conventional needle plate finger because the size and strength of the needle plate finger members 90 do not have to be as great as that of conventional needle plate fingers. The main function of the needle plate fingers 90 is to support a portion of the base fabric surrounding the rear needles 28. The portion of the base fabric surrounding the front needles 27 is primarily supported by the top surface of the rear portion of the needle plate member 34 by virtue of the notches 84 surrounding the front portion of each front needle 27.

As disclosed in FIG. 6, the length of each tine 93 and 94 is relatively short. The tines 93 and 94 project rearward on opposite sides of a corresponding rear needle 28, but in most instances do not terminate beyond the vertical, central axis of the rear needle 28.

Because of the limited rearward projection of the tines 93 and 94, and the relatively shallow depth of the tines 93 and 94, the resistance to lateral movement of the yarns 31 and 32 is minimal as the base fabric 30 is shifted laterally back and forth, while the yarns are still held on the respective hooks 40 and 40$^1$ . Furthermore, the diverging sides 85 and 86 of the notches 84 and the diverging tines 93 and 94 of the forked end portions 92 of the finger members 90 provide wide openings for the rear exit movement of the yarn loops 100 (FIGS. 3 & 6) from the bills of the corresponding looper hooks 40 and 40$^1$.

The relative shallow depth of the needle plate fingers 90 also permits the looper hooks 40 and 40$^1$ to occupy a more elevated position relative to the needle plate 34 and the base fabric 30, if desired, in order to produce relatively low, cut-pile tufts.

The shank portions 91 of each of the needle plate fingers 90 also provide additional support for the base fabric 30 around the front needles 27, as well as the rear needles 28.

One typical example of a needle plate member 34 is a solid, spring metal plate having a thickness of approximately $\frac{1}{4}''$ with needle plate fingers having a depth of $\frac{1}{8}''$ and a width or transverse dimension of 0.044". Each notch is approximately 0.081" deep, and the longitudinal spacing between the apex of each notch 84 and the apex of the converging tines 93 and 94 is approximately equal to the stagger of the front and back rows of needles. The stagger is the longitudinal distance between the rows of the back and front needles. In one typical instance, where the stagger is $\frac{3}{8}''$, the needle gauge is 5/64", that is the lateral spacing between the adjacent needles 27 and 28 in both rows.

Figures 7, 8, 9, 10, 19, 20:
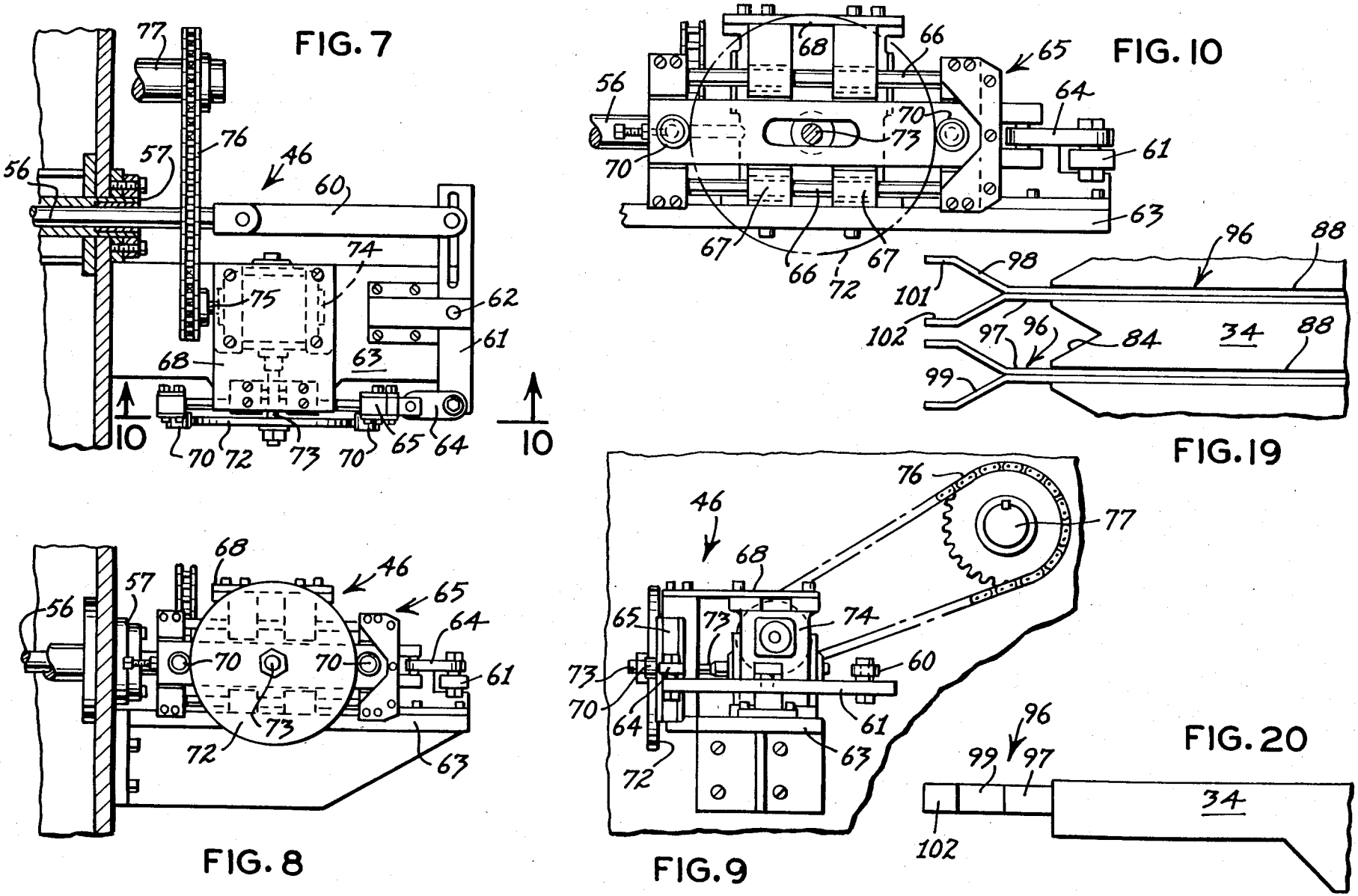
FIG. 7 is a fragmentary top plan view of the pattern control mechanism for operating the backing fabric shifter mechanism.
FIG. 8 is a fragmentary rear elevational view of the pattern control mechanism disclosed in FIG. 7.
FIG. 9 is a fragmentary end elevational view of the pattern control mechanism disclosed in FIG. 8.
FIG. 10 is a fragmentary sectional elevation taken along the line 10—10 of FIG. 7.
FIG. 19 is an enlarged fragmentary plan view of a rear edge portion of a modified needle plate member.
FIG. 20 is a fragmentary end elevational view of the needle plate member disclosed in FIG. 19.

FIGS. 19 and 20 disclose the needle plate member 34 with the same notches 84 and grooves 88, but supporting needle plate fingers 96 of slightly different construction. The shank structure 97 and rearward diverging tines 98 and 99 are substantially the same as the needles 90. However, the rear ends of the tines 98 and 99 terminate in rearward projecting, substantially parallel, tine extensions 101 and 102. The purpose of these tine extensions 101 and 102 is to provide additional support for the backing fabric surrounding the rear needles 28. There is a trade-off between the degree of fabric support, and therefore the length of the tine extensions 101 and 102 and the resistance or drag exerted by the tine extensions 101 and 102 against the yarn held by the tufting hooks 40 and 40$^1$ as the base fabric is laterally shifted.

FIGS. 13–18 schematically illustrate a stitching sequence for the front needle 27 and its corresponding yarn 31 and looper hook 40$^1$, as the base fabric 30 is laterally shifted first in one direction (left) and then in the opposite direction (right). Although FIGS. 14 and 18 illustrate the base fabric 30 being moved in its respective lateral direction while the needle 27 is in a raised position, nevertheless, the base fabric 30 can be moved through part of its cycle while the needle 27 is penetrating the base fabric 30. Such coincidental fabric movement and needle penetration is permitted because of the yieldability or elasticity of the fabric 30, even though the pin roller 38 is being positively moved in either lateral direction while the needle 27 is also being positively reciprocated vertically.

FIG. 12 illustrates the lateral movement of the fabric 30 alternately in opposite directions relative to the needles 27 and 28 to produce the wave-like patterns. Because the needles 27 and 28 usually penetrate the base fabric 30 before the completion of the lateral shifting cycle of the pin roller 48, the gauge of the stitching 105 is usually less than the needle gauge to produce dense cut-pile fabric without a regular geometric pattern appearance.

It will be understood that other patterned fabrics may be obtained by substitution of pattern cams 72 having different peripheral configurations.

As illustrated in FIG. 3, the pin roller 48 is spaced rearward of the needles 27 and 28. Thus, as the pin roller 48 shifts laterally, it tends to swing the base fabric 30 about the pivotal axes of the needles 27 and 28 particularly as the needles 27 and 28 penetrate the base fabric 30. Accordingly, the pattern cam 72 is designed in such a manner that the pin roller 48 is overshifted, that is shifted a lateral increment greater than the ultimate lateral distance between the stitches 105.

It is therefore apparent that a needle plate member 34 for a staggerd needle tufted machine 21 has been designed which will adequately support the portions of the base fabric 30 surrounding both rows of front and rear needles 27 and 28 while the cut-pile tufts 110 (FIG. 17) are formed. More importantly, the needle plate member 34 with its unique notches 84 and needle plate finger members 90 and 96 permit the formation of relatively dense cut-pile in a base fabric 30 with a minimum of resistance or drag caused by the yarns 31 and 32 against the finger members 90 and 96 while the loops 33 are seized on the looper hooks 40 and 40$^1$ and while the base fabric 30 is being laterally shifted over the needle plate member 34.

Moreover, the needle plate finger members 90 and 96 incorporated in the needle plate member 34 may be substantially smaller in size, and particularly in depth and length, than those needle plate fingers conventionally incorporated in multiple needle tufting machines. Such shallow needle plate fingers permit the looper hooks 40 and 40$^1$ to be elevated closer to the needle plate 34, as well as permitting the ready exit of the formed loops from the respective notches 84 and forked end portions 92 of the needle plate member 34 and finger members 90 and 96, respectively. Moreover, the smaller needle plate fingers 90 and 96, particularly in regard to their lengthwise dimension, minimizes the resistance or impedance to the lateral movement of the base fabric 30 and the yarns 31 and 32.

It has been found in actual practice that the tufting machine 21 incorporating the novel needle plate member 34 permits the production of low cut-pile tufts in staggered needle fabrics more successfully than by a tufting machine incorporating the lowpile needle plate of the Watkins U.S. Pat. No. 4,503,787.

Moreover, because of the ability to laterally shift the fabric, instead of the needles, the needle bar, or the needle plate, less precision is required in the synchronism of the tufting elements for shifting the base fabric relative to the needles, because of the yieldability and flexibility of the base fabric itself.

Furthermore, the needle plate member 34 made in accordance with this invention permits the production of narrower gauge cut-pile tufting in a staggered needle machine than in a staggered needle machine incorporating conventional needle plates and needle plate fingers.

Moreover, because of the lesser resistance to the movement of the yarns by the shorter and shallower needle plate fingers, the backing fabric carrying the yarns which are seized by the looper hooks may be moved more rapidly and thereby increase the production of the cut-pile fabric.

It has also been discovered that when a needle plate member 34 is incorporated in a multiple needle tufting machine for making loop pile fabric, not shown, snagginq or tagging of loops formed by needles, such as needles 27, penetrating the area within the notches 84, is minimized, if not eliminated. Occasionally, a yarn loop tends to be dragged forward into the needle path by a retracting or withdrawing looper hook pointing in the direction of the fabric feed. The lands 87 between each V-shaped notch 84 block the forward movement of the corresponding loop and strip the loop from its corresponding looper hook. This arrangement is particularly effective where the needle plate member 34 is used in a staggered needle tufting machine such as that disclosed in U.S. Pat. No. 3,919,953 of Roy T. Card, et al, in which the front row of needles form loop pile while the back row of needles form cut pile. By lowering the loop pile hooks and increasing the thickness of the needle plate member 34, or the effective thickness by adding shims, thereby increasing the height of the notches 84, high loop pile and low cut pile can be produced without tagging the pile loops.

What is claimed is:

1. In a staggered needle tufting machine having a front transverse row of uniformly spaced reciprocable front needles and rear transverse row of uniformly spaced reciprocable rear needles uniformly offset from said front needles, the front and rear needles being adapted to carry yarn through a base fabric movable longitudinally through the machine, and a looper hook for each needle having a bill for seizing and forming a loop in each yarn carried through the base fabric by the corresponding needle, fabric support means for supporting the base fabric between the staggered needles and the looper hooks, comprising:

(a) an elongated needle plate having a longitudinal dimension and a transverse dimension and a free transverse edge portion, (b) means supporting said needle plate so that said free edge portion extends transversely of the machine and closely adjacent the reciprocable paths of the transverse row of said front needles, (c) a plurality of notches, there being one notch for receiving each said front needle as said needles penetrate the base fabric, (d) each said notch comprising a pair of opposed walls on opposite sides of the path of a corresponding reciprocable front needle, said side walls diverging rearward to form an opening through said transverse edge portion to permit the free rearward passage of the tufted pile loops formed by said front needles, (e) a plurality of finger members, each finger member projecting rearward from said edge portion between adjacent pairs of said notches, (f) each finger member comprising a shank portion projecting rearward from said free edge portion and terminating in a forked portion comprising a pair of rearward diverging tines spaced on each side of the path of a corresponding reciprocable rear needle, (g) said needle plate and said finger members supporting the adjacent portions of said base fabric stitched by said front and rear needles, (h) fabric shift means behind said finger members and engaging said base fabric, (i) means laterally shifting said shift means reciprocably to move said base fabric transversely relative to said needle plate, (j) said tines terminating in rear ends, each said rear end being transversely spaced from the adjacent rear end of an adjacent finger member to permit the rearward passage of the tufted pile loops formed by the front needle between said adjacent rear ends of adjacent finger members, and (k) said rear ends terminating adjacent a transverse line intersecting the vertical paths of said rear needles to disengage the loops formed by said needles when said loops move behind said rear ends and to permit free lateral shifting movement of the portion of the base fabric adjacent said rear needles.

2. The invention according to claim 1 in which each of said looper hooks comprises a cut-pile looper hook pointing longitudinally forward, and further comprising a knife for each looper hook, and means for reciprocably moving said knives to cooperate with said corresponding looper hooks to form cut pile tufts.

3. The invention according to claim 1 in which each of said notches is V-shaped.

4. The invention according to claim 1 in which said rear ends terminate in front of said transverse line.

5. The invention according to claim 1 in which said rear ends of said tines form parallel rearward projecting tine extensions.

6. The invention according to claim 5 in which said tine extensions project rearwardly slightly beyond said transverse line.

7. The invention according to claim 1 in which the vertical dimension of said finger members is substantially less than the vertical thickness of said needle plate.

8. The invention according to claim 1 in which said means laterally shifting said shift means comprises means for laterally shifting the base fabric in increments less than the needle gauge in order to produce relatively dense tufted pile fabric.

9. The invention according to claim 8 in which said means laterally shifting said shift means comprises pattern control means causing each needle to produce at least two rows of tufting in said base fabric, said rows having a transverse spacing less than said needle gauge.

* * * * *